US005269709A

United States Patent [19]

Eriksson

[11] Patent Number: 5,269,709

[45] Date of Patent: Dec. 14, 1993

[54] BATTERY TERMINAL POST CLAMP ADAPTED FOR CONNECTION TO AN EXTERNAL ELECTRIC POWER SOURCE OR CONSUMER

[76] Inventor: Lars Eriksson, Hättinge 3445, S-635 05 Eskilstuna, Sweden

[21] Appl. No.: 720,533

[22] PCT Filed: Nov. 24, 1989

[86] PCT No.: PCT/SE89/00687

§ 371 Date: Jun. 20, 1991

§ 102(e) Date: Jun. 20, 1991

[87] PCT Pub. No.: WO90/07197

PCT Pub. Date: Jun. 28, 1990

[30] Foreign Application Priority Data

Dec. 22, 1988 [EP] European Pat. Off. ..... 88850433.9

[51] Int. Cl.[5] ..... H01R 4/50

[52] U.S. Cl. ..... 439/772; 439/522; 439/773

[58] Field of Search ..... 439/159, 160, 366, 522, 439/772, 773, 863, 864, 893

[56] References Cited

U.S. PATENT DOCUMENTS

| | | | |
|---|---|---|---|
| 1,930,772 | 11/1931 | Richter et al. . | |
| 2,185,419 | 7/1939 | Packard . | |
| 2,257,013 | 4/1941 | Johnson . | |
| 3,324,266 | 4/1965 | Evans . | |
| 3,568,139 | 3/1971 | Delzer . | |
| 3,973,820 | 8/1976 | Benson . | |
| 4,758,188 | 7/1988 | Yates | 439/772 |

FOREIGN PATENT DOCUMENTS

| | | | |
|---|---|---|---|
| 0027438 | 4/1981 | European Pat. Off. . | |
| 1250519 | 9/1967 | Fed. Rep. of Germany | 439/773 |
| 44023 | 4/1971 | Finland . | |
| 129178 | 8/1950 | Sweden . | |
| 2184900 | 7/1987 | United Kingdom | 439/522 |

*Primary Examiner*—Paula A. Bradley
*Attorney, Agent, or Firm*—Quarles & Brady

[57] ABSTRACT

A battery terminal post clamp including a quick coupling device for its connection to a battery terminal post and operating means for operating the quick coupling device, said operating means being provided with an insulated handle means. The insulated handle means (320 is connected to the operating means (120 by lost motion means (37, 38, 39, 40) allowing the handle means (32) to be moved a limited distance without operating the quick coupling device to disengage said battery terminal post, said limited distance enabling access to metallic parts of the clamp.

8 Claims, 3 Drawing Sheets

PRIOR ART

BATTERY TERMINAL POST CLAMP ADAPTED FOR CONNECTION TO AN EXTERNAL ELECTRIC POWER SOURCE OR CONSUMER

The present invention concerns a battery terminal post clamp including a metallic quick coupling device for its connection to a battery terminal post and an operating means for operating the quick coupling device.

Battery terminal post clamps of this general kind are described in a. o. U.S. Pat. Nos. 1,930,722, 2,185,419, 2,257,013, 3,324,266 and SE-A-129 178.

Another example of such a battery terminal post clamp is described in European Patent EP-B-0 027 438 and corresponding Swedish and patents SE-C-7908486-9 and U.S. Pat. No. 4,385,796, respectively. The battery terminal post clamp of these patents includes a first substantially U-shaped part having a bottom portion and parallel legs extending therefrom, and a second likewise substantially U-shaped part having a bottom portion and parallel legs extending therefrom. The bottom portions of the two parts are complementary shaped so as to substantially conform to the shape of a battery terminal post in the operative position of the clamp, while the legs of the two parts are mutually parallel. The two parts are adapted to be displaced relative to each other to and from the operative position by means of an overcenter device connected to the two parts. The overcenter device includes a substantially U-shaped operating lever, by means of which the two parts are displaced relative to each other in order to make the clamp engage or disengage a battery terminal post.

Not only the two parts but also the operating lever are manufactured of metal. In order to protect a user against electric shocks and also to avoid inadvertent short circuits caused by e.g. dropped metallic tools, the operating lever, in a commercial embodiment this known battery terminal post clamp, is accomodated in a shell-like casing of insulating material, such as a molded synthetic resin. In the operative, closed position of the battery terminal post clamp, this casing, serving also as a handle for the lever, covers not only the operating lever, but also the two parts engaging a battery terminal post and portions thereof connected to an electric cable. The casing is rigidly attached to the operating lever such that movement of the casing is positively transferred to the operating lever.

In some instances, such as a low voltage condition in the battery to which the battery terminal post clamp is connected, or, in another, external battery, there is a need to temporarily connect a second cable (a so called starting-cable) to each of the battery terminal posts in order to connect them to the respective poles of an outer electric source, or, the terminal posts of the external battery, respectively. This may be the case when attempts to start the motor of a motor vehicle fail due to a low voltage condition in the battery of the vehicle.

In order to connect a second cable to the known battery terminal post clamp having a casing as described, or , to the battery terminal post to which it is connected, it is necessary to disengage the clamp by raising the casing and the lever attached thereto to make a metallic part of the clamp, or, the battery terminal post itself accessible. Apart from the work involved, such disengagement may cause serious damage to the electrical circuit of a motor vehicle if the electrical connection is interrupted, particularly in cases where such circuitry includes an alternating current generator, and the motor of the vehicle driving the generator is running.

Also the battery terminal post clamps described in the patents initially cited include metallic battery terminal post engaging parts as well as metallic operating levers or other operating means for engaging and disengaging the clamps. If these known battery terminal post clamps were provided with insulating handle means as described above they too would suffer from the same disadvantages.

Consequently, there is a need for a battery terminal post clamp enabling electrical connection of a second cable to a battery terminal post without disengaging the clamp.

The object of the present invention, thus, is to provide a battery terminal post clamp of the kind initially stated and having an insulated handle means with means enabling such connection.

In a battery terminal post clamp including a quick coupling device for its connection to a battery terminal post and an operating means for operating the quick coupling device, said operating means being provided with an insulated handle means, this object has been achieved in that the insulated handle means is connected to the operating means by lost motion means allowing the handle means to be moved a limited distance without operating the quick coupling device to disengage said battery terminal post, said limited distance enabling access to metallic parts of the clamp.

An embodiment of the present invention, based on the battery terminal post clamp described in EP-B-0 027 438 cited above, will now be described, reference being made to the accompanying drawings, wherein.

Figure 1:
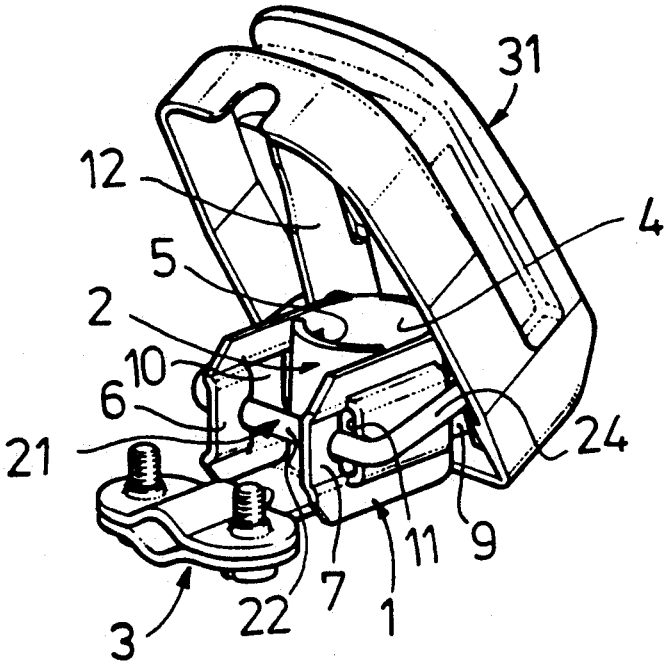
FIG. 1 is a perspective view showing a battery terminal post clamp of the known kind in an open position.
Figure 2:
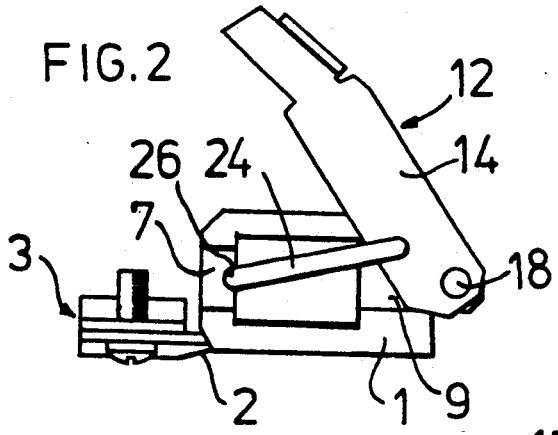
FIG. 2 is a side view showing the mechanism of a battery terminal post clamp according to the present invention in an open position.
Figure 4:
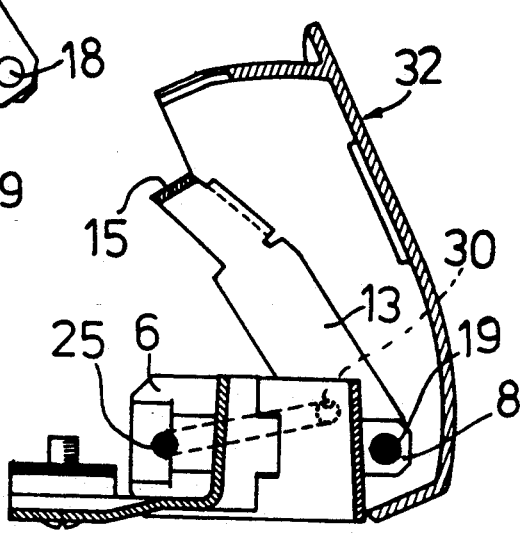
FIG. 4 is a longitudinal section through the battery terminal post clamp according to the present invention in an entirely open, disengaged position.
Figure 3:
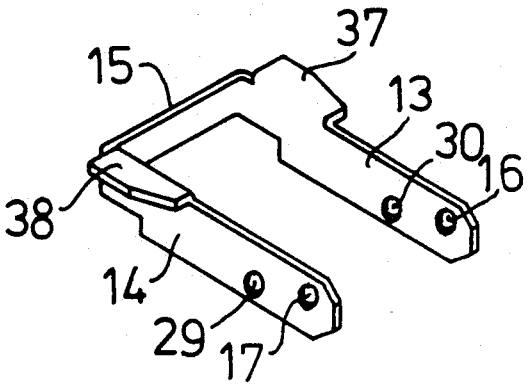
FIG. 3 is a perspective view showing the operating lever of the battery terminal post clamp according to FIG. 2.

The battery terminal post clamp according to the European Patent mentioned comprises a first part 1 and a second part 2, which are displaceable relative to each other, said parts preferably being punched and bent sheet metal parts. An electric cable connection 3 is formed integrally with the second part 2 and is adapted to be clamped around a battery cable (not shown). Parts 1 and 2 are shaped with cooperating substantially U-shaped portions 4 and 5, respectively, defining in the operative state of the battery terminal post clamp a substantially frusto-conical space conforming to the shape of an ordinary battery terminal post. Each of the parts has mutually parallel legs 6,7 and 8,9, respectively, extending from the respective U-shaped portion. In order to achieve mutual guidance during relative displacement of the parts towards and from each other, the legs 6, 7 of the first part 1 are provided with guide pockets 10,11, respectively, through which extend the legs 8,9 of the second part 2.

A substantially U-shaped operating lever 12, comprising two generally parallel legs 13,14 and a bridging web portion 15, has the ends of its legs extending outside of the legs 8,9 of part 2 and by means of holes 16,17 provided therein pivoted on a shaft 18 extending between holes 19,20 at the ends of the legs 8,9 of the second part 2. A substantially U-shaped link 21 having a middle portion 22 and two parallel legs 23,24 extending therefrom is introduced with its middle portion 22 through holes 25,26, respectively, at the free ends of the legs 6 and 7 of the first part 1. Inwardly bent ends 27,28, respectively, of the legs 23,24 are engaged in corresponding holes 29,30, respectively, in the legs 13,14 of the operating lever. In the operative, closed position of the battery terminal post clamp the holes 29,30 and, consequently, the inwardly bent ends 27,28 of the legs 23,24 of link 21, are located a small distance below an imaginary plane through holes 19,20 and 25,26, and consequently, shaft 18 and middle portion 22 of link 21. There is created, thus, an overcentre mechanism controlling the relative displacement of parts 1 and 2 by raising or lowering the operating lever 12, said mechanism having a deadpoint when the inwardly bent ends 27,28 of legs 23,24 pass through the imaginary plane mentioned.

In a commercial embodiment of the known battery terminal post clamp described, an insulating handle 31 of molded plastics material is mounted on the operating lever 12 such that no metallic part of the battery terminal post clamp is accessible when the clamp is engaged on a battery terminal post and such that the operating lever positively follows any movement of the handle. As initially mentioned, when operating the handle in an opening direction, this causes immediate disengagement of the battery terminal post clamp. In order to avoid this drawback, the battery terminal post clamp of the present invention is provided with a handle which allows a certain amount of opening movement before the mechanism is operated to disengage the battery terminal post clamp.

In order to achieve this feature the battery terminal post clamp of the present invention is provided with a substantially shell-like handle 32 preferably being a molded plastics part. Close to one end of its opposed longitudinal walls 33,34 the handle is provide with inwardly open holes 35,36, respectively, said holes engaging the ends of shaft 18 extending through legs 8,9 of part 2 and legs 13,14 of operating lever 12. Since this is the only positive engagement between the metallic parts of the battery terminal post clamp and its handle, the handle is swingable about shaft 18 relative to the metallic parts.

In order to transfer swinging motion of the handle 32 to the operating lever 12, the operating lever and the handle are provided with cooperating lost motion means. On the operating lever 12 such means comprises outwardly bent ears 37,38 integral with the legs 13 and 14, respectively, and being located close to the leg bridging web portion 15. For abutting cooperation with the ears 37,38 in the opening direction of the handle (clockwise in FIG. 5) the longitudinal walls 33,34 of handle 32 are interiorly provided with inwardly protruding abutments 39,40. In the closing swinging direction of the handle abutment takes place between the upper interior wall 41 of the handle, or, preferably, longitudinally directed protrusions 42,43 integral with this wall, and the ears 37,38. The angle defined by the upper wall 41, or, its protrusions 42,43, the shaft 18, and the abutments 37,38, thus, is the lost motion angle within which the handle may swing without operating the operating lever when being moved from its closed position according to FIG. 6.

Figure 5:
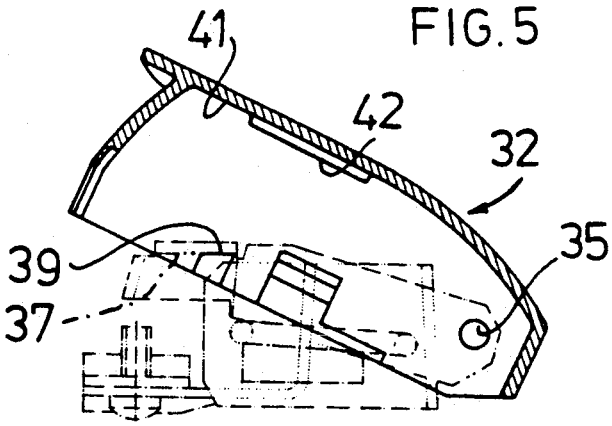
FIG. 5 is a view similar to that of FIG. 4 showing the battery terminal post clamp with its handle in a raised position but the mechanism of the clamp still in an engaged position, the mechanism being shown with dash-dotted lines.
Figure 6:
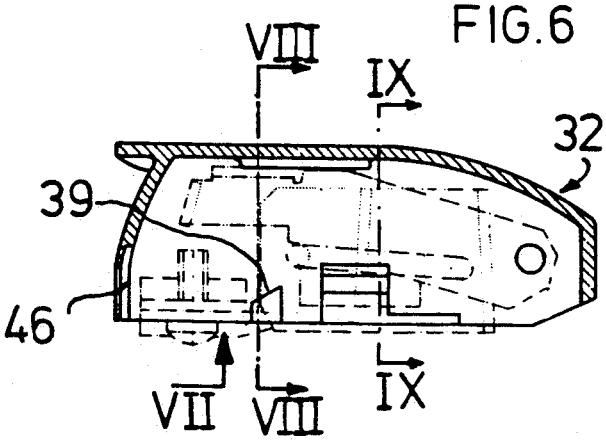
FIG. 6 is a view similar to that of FIG. 5 showing the battery terminal post clamp in a closed position.

As appears from FIG. 6 the abutments 39,40 preferably have inclined upper abutment surfaces, the inclination being such as to obtain surface contact with the undersides of ears 37,38 when the handle reaches the end of its lost motion travel (FIG. 5).

Figure 7:
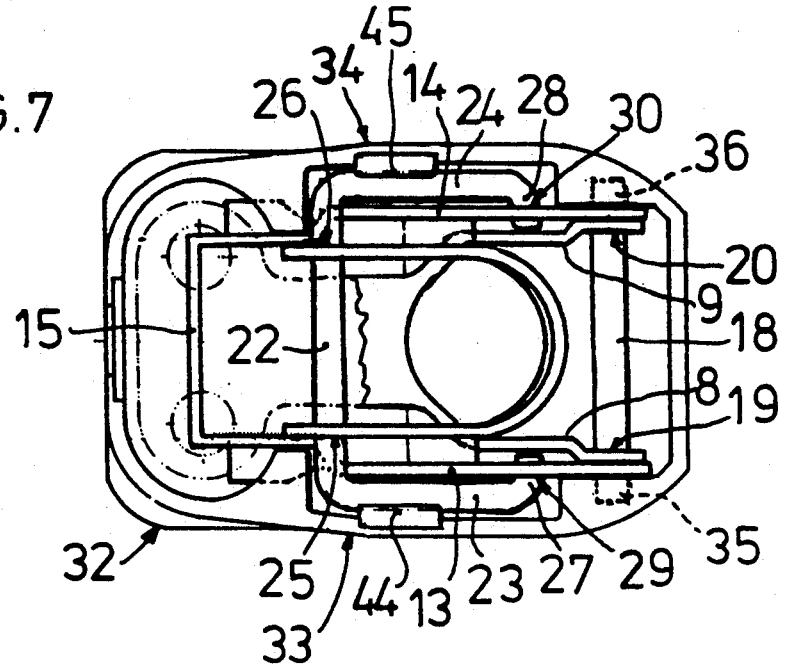
FIG. 7 is a view in the direction of arrow VII in FIG. 6.
Figure 8:
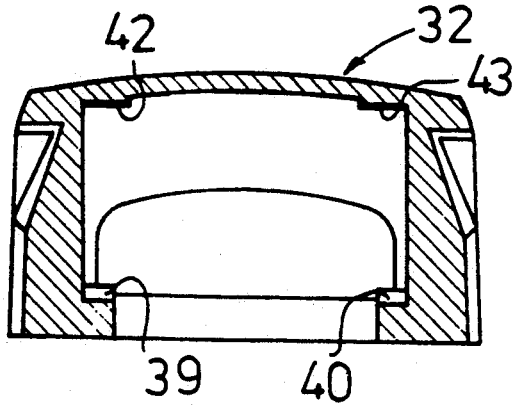
FIG. 8 is a section through the handle only taken along line VIII—VIII in FIG. 6.
Figure 9:
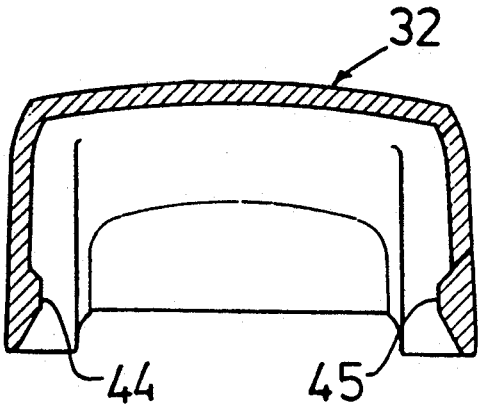
FIG. 9 is a section through the handle only taken along line IX—IX in FIG. 6.

In order to retain the handle in its closed position (FIG. 6) the longitudinal walls 33,35 thereof are interiorly provided with ribs 44,45 (FIGS. 7 and 9) extending in the longitudinal direction of the handle and protruding inwardly so as to snap over the legs 23,24 of link 21 when bringing the handle to its closed position. Such snapping action of ribs 44,45 is enabled due to the handle being made from a relatively elastic thermoplastic material.

To accomodate an electric cable attached to the connection 3 when the handle is in the closed position shown in FIG. 6, the handle 32, as well as handle 31 shown in FIG. 1, is provided with an opening 46.

As is apparent from the foregoing description, the handle 32 of the battery terminal post clamp according to the present invention may be raised from the closed position shown in FIG. 6 to the position shown in FIG. 5, thereby enabling access to metallic parts of the clamp, such as for temporary connection of a second cable, without affecting the engagement of the battery terminal post clamp to a battery terminai post.

I claim:

1. A battery terminal post clamp, comprising:

means for releasably clamping the post, said clamp means being connectable to an electric cable;

a lever for actuating said clamp means, said lever being pivotally connected at one of its ends to said clamp means and being pivotable between a closed position wherein said clamp means clamps the post and an open position wherein said clamp means releases the post;

an electrically insulated handle pivotally connected to said lever; and lost motion means for allowing said handle to pivot from a cover position covering said clamp means, through a limited angle before actuating said lever to said open position, said handle uncovering said clamp means to expose metallic parts thereof at said limited angle.

2. The battery terminal post clamp according to claim 1, wherein the height of the clamp means is exposed at one end of the clamp means when said handle pivots to said limited angle.

3. A battery post clamp according to claim 1, characterized in that said lost motion means comprises cooperating respective portions of said handle and of said lever, said portions being spaced from said one end of the said handle and said end of said lever, respectively.

4. A battery terminal post clamp according to claim 1, characterized in that said respective cooperating portions are abutments on said handle and on said lever.

5. A battery terminal post clamp according to claim 4, characterized in that said portion of said handle is integrated in said handle.

6. A battery terminal post clamp according to claim 4, characterized in that said portion of said lever comprises a flap protruding from said lever.

7. A battery terminal post clamp according to any one of the preceding claims, characterized in that said handle includes means for interlocking with portions of the said clamp means in the cover position of said handle to prevent unintended opening thereof.

8. A battery terminal post clamp including a quick coupling device for its connection to a battery terminal post and operating means for operating the quick coupling device, said operating means being provided with an insulated handle means, characterized in that the insulated handle means is connected to the operating means by lost motion means allowing the handle means to be moved a limited distance without operating the quick coupling device to disengage said battery terminal post, said limited distance enabling access to metallic parts of the clamp, said handle means including means for interlocking with portions of said quick coupling device in the closed position of said handle means to prevent unintended opening thereof, wherein said interlocking means comprises inwardly protruding ribs integral with said handle means.

* * * * *